US009932862B2

(12) United States Patent
Gibble

(10) Patent No.: US 9,932,862 B2
(45) Date of Patent: Apr. 3, 2018

(54) METHOD AND APPARATUS FOR HEATING AN EXPANSION MACHINE OF A WASTE HEAT RECOVERY APPARATUS

(71) Applicant: VOLVO TRUCK CORPORATION, Göteborg (SE)

(72) Inventor: John Gibble, Chambersburg, PA (US)

(73) Assignee: VOLVO TRUCK CORPORATION, Göteborg (SE)

( * ) Notice: Subject to any disclaimer, the term of this patent is extended or adjusted under 35 U.S.C. 154(b) by 183 days.

(21) Appl. No.: 14/760,745

(22) PCT Filed: Jul. 18, 2013

(86) PCT No.: PCT/US2013/051034

§ 371 (c)(1),
(2) Date: Jul. 14, 2015

(87) PCT Pub. No.: WO2014/123572

PCT Pub. Date: Aug. 14, 2014

(65) Prior Publication Data

US 2015/0354414 A1 Dec. 10, 2015

Related U.S. Application Data

(60) Provisional application No. 61/761,337, filed on Feb. 6, 2013.

(51) Int. Cl.
*F01K 13/02* (2006.01)
*F01K 23/06* (2006.01)

(52) U.S. Cl.
CPC ..... *F01K 23/06* (2013.01); *F01K 13/02* (2013.01); *F01K 23/065* (2013.01)

(58) Field of Classification Search
CPC ..... F01D 25/10; F01D 25/14; F01K 13/02; F01K 23/06
See application file for complete search history.

(56) References Cited

U.S. PATENT DOCUMENTS 5,172,553 A 12/1992 Barton et al.
7,950,230 B2 5/2011 Nishikawa et al.
(Continued)

FOREIGN PATENT DOCUMENTS

CN 102042120 A 5/2011
DE 102007008609 A1 8/2008
(Continued)

OTHER PUBLICATIONS

Machine translation of DE102007008609B4, accessed on Jun. 9, 2017.*
(Continued)

*Primary Examiner* — Jonathan Matthias
(74) *Attorney, Agent, or Firm* — Martin Farrell; Michael Pruden

(57) ABSTRACT

A waste heat recovery apparatus, for use with an internal combustion engine, includes a working fluid circuit to circulate working fluid, a boiler connected on the working fluid circuit and adapted to recover waste heat from a source to heat working fluid, an expander connected on the working fluid circuit to receive working fluid from the boiler, and, a heating jacket associated with the expander. The working fluid circuit downstream of the boiler includes a first branch connecting to an inlet of the expander and a second branch connecting to the heating jacket. A valve is connected on the working fluid circuit to selectively control working fluid flow to one of the first branch for expansion and recovering work or to the second branch to heat the expander responsive to a temperature of the working fluid.

14 Claims, 5 Drawing Sheets

(56) References Cited

U.S. PATENT DOCUMENTS

| | | | |
|---|---|---|---|
| 2010/0263380 | A1 | 10/2010 | Biederman et al. |
| 2011/0072818 | A1 | 3/2011 | Cook |
| 2011/0088394 | A1 | 4/2011 | Mori et al. |
| 2011/0203278 | A1 | 8/2011 | Kopecek et al. |
| 2012/0036850 | A1 | 2/2012 | Ernst et al. |
| 2013/0283790 | A1 | 10/2013 | Rewers et al. |

FOREIGN PATENT DOCUMENTS

| | | | | | |
|---|---|---|---|---|---|
| DE | 102010042405 | A1 | * | 4/2012 | ..... F01K 3/22 |
| GB | 813330 | A | * | 5/1959 | ..... F01D 9/06 |
| JP | S60247001 | A | | 12/1985 | |
| JP | 2009-097387 | A | | 5/2009 | |
| SU | 972153 | A1 | | 11/1982 | |
| WO | 9855738 | A1 | | 12/1998 | |
| WO | 2012131022 | A2 | | 10/2012 | |

OTHER PUBLICATIONS

Extended European search report dated Oct. 6, 2016 for corresponding European application No. 213874392.7.
2nd CN office action dated Nov. 3, 2016 for corresponding China application No. 201380072386.0 translated.
International Search Report (dated Jan. 7, 2014) for corresponding International App. PCT/US2013/051034.
Written Opinion (dated Jan. 7, 2014) for corresponding International App. PCT/US2013/051034.
CN office action dated Mar. 25, 2016 for corresponding China application No. 201380072386.0 translated.
JP application 2015-556927 Office Action dated Oct. 30, 2017 (application corresponds to U.S. Appl. No. 14/760,745).

* cited by examiner

METHOD AND APPARATUS FOR HEATING AN EXPANSION MACHINE OF A WASTE HEAT RECOVERY APPARATUS

FIELD OF THE INVENTION

The invention relates to bottoming cycle apparatuses, such as Rankine cycle apparatuses, for recovering energy from waste heat of internal combustion engines, and more particularly, to the expansion machine of such an apparatus.

BACKGROUND AND SUMMARY

For a bottoming cycle apparatus, such as an apparatus based on the Rankine cycle, system efficiency is related directly to the up-time, that is, the operational time during which recovery of waste heat occurs. Inactive periods are often due to poor quality heat being available (not enough waste heat) or due to component warm-up time (when boilers and expansion machines are warming up).

The invention proposes a solution to increase operational time by improving thermal management during periods of poor quality heat availability and to decrease the warm up time of the apparatus when returning to operation.

The invention is applicable to bottoming cycles such as the Rankine cycle, the Ericsson cycle and other waste heat recuperating cycles.

According to the invention, an expansion machine of a bottoming cycle apparatus is connected in a working fluid circuit to receive working fluid from a heat recovery heat exchanger, such as a boiler, vaporizer, or heat exchanger. The working fluid directed to an expansion machine is expanded in the expansion machine to generate usable work or energy. The expansion machine also includes a heating jacket that is connected to receive working fluid for the purpose of heating the expansion machine. A bypass valve controls whether the working fluid is directed to the expansion inlet or the heating jacket.

Control of the bypass valve is based on the temperature of the working fluid (which may be measured at the outlet of the boiler) and the temperature of the expander (which may be measured at a convenient location). The bypass valve may also be regulated based on other conditions such as, but not limited to, control of expansion machine rotational speed, working fluid temperature regulation, or expansion machine torque demand (such as a request to stop power generation during engine brake mode).

According to the invention, an expander may be a turbine machine, a piston machine, a scroll, a screw, or another device capable of extracting useful work by expanding a working fluid. A multistage expander arrangement may be used in an apparatus according to the invention, with bypass being selectively controlled for one or more stages.

According to the invention, the heating jacket may be in the form of a water jacket.

DETAILED DESCRIPTION

Figure 1:
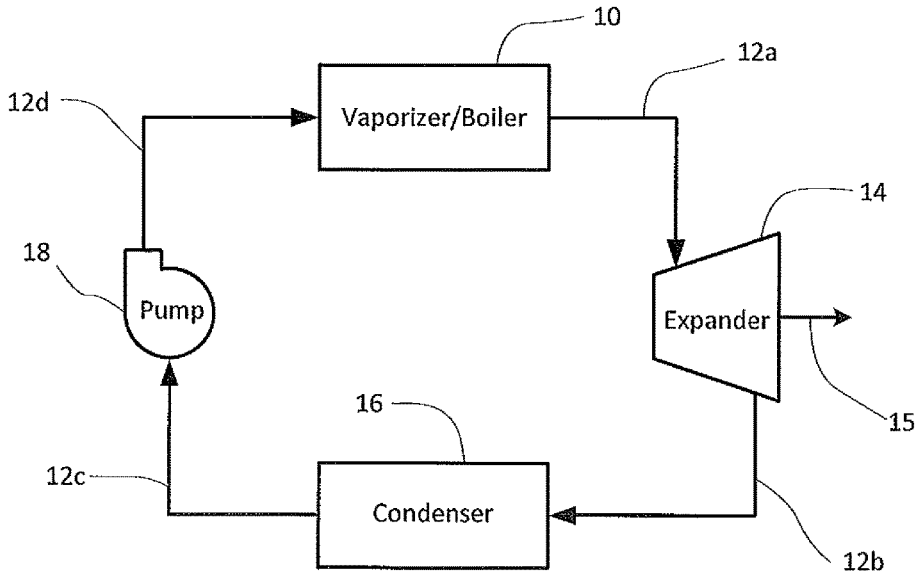
Figure 1 Prior Art
FIG. 1 is a schematic view of a typical Rankine cycle apparatus according the prior art.

As seen in FIG. 1, a typical bottoming cycle waste heat recovery apparatus includes a vaporizer or boiler 10 to recover heat from a heat source (not illustrated), such as waste heat from an internal combustion engine exhaust, engine coolant, engine oil cooler, or other source, to heat a working fluid. Working fluid is carried through the apparatus by a working fluid circuit 12. The heated working fluid exiting the boiler 10 is directed through a working fluid circuit line 12*a* to an expansion machine or expander 14, which generates work by expanding the working fluid. The expander may be a turbine, a piston engine, a scroll, a screw, or other machine. The generated work may be transmitted through a shaft 15, and may be used, for example, in driving an electrical generator or as mechanical power added to the drive shaft of the internal combustion engine. Expanded working fluid is directed through the circuit line 12*b* to a condenser 16, which removes heat from and condenses the working fluid. The condensed fluid is then directed by through a circuit line 12*c* to a pump 18, which compresses the working fluid. A circuit line 12*c* carries the working fluid from the pump 18 to the boiler 10 to repeat the waste heat recovery cycle.

Figure 2:
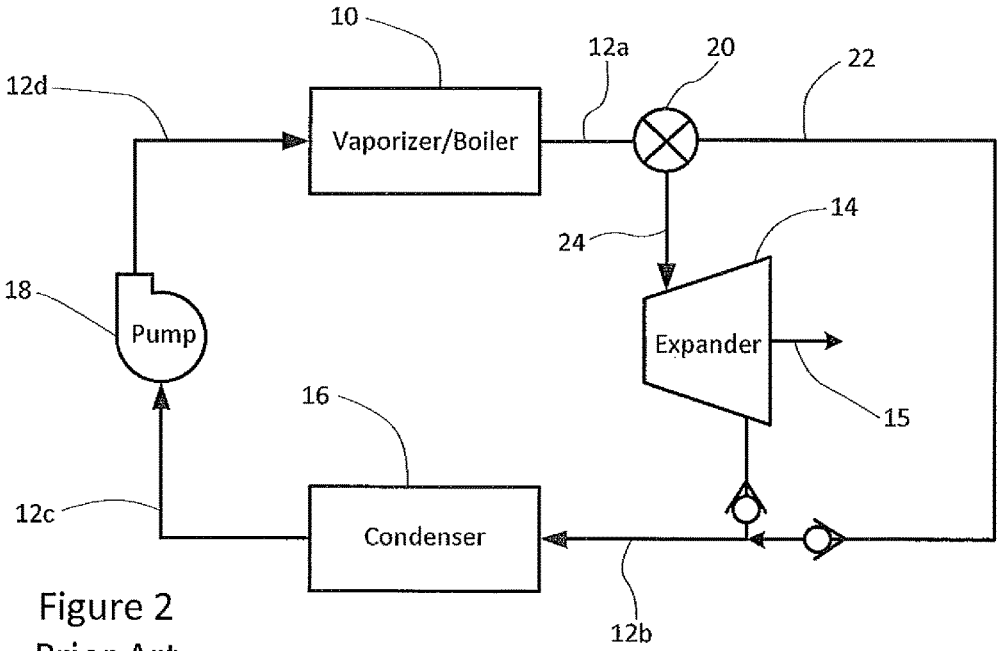
Figure 2 Prior Art
FIG. 2 is a schematic view of a Rankine cycle apparatus having a bypass circuit for working fluid for bypassing the expansion machine.

As seen in FIG. 2, and also known in the art, a bottoming cycle waste heat apparatus may include a bypass valve 20 and bypass circuit 22 to direct working fluid around the expander 14 to the condenser 16. The bypass valve 20 may be controlled to direct the working fluid to the expander 14 through line 24 when the working fluid is at operational condition, or through line 22 to bypass the expander 14 when the quality of the working fluid is not sufficient for expansion, that is, there is not enough waste heat available at the boiler 10 to heat the working fluid to an operational temperature, for example, as superheated steam. The condenser 16 cools the working fluid received from the bypass circuit and the cooled fluid is pumped by the pump 18 to the vaporizer/boiler 10.

The bypass valve 20 controls whether the working fluid is directed to the expander 14 or the bypass circuit 22 around the expander. When the working fluid is at an operational temperature, the bypass valve 20 closes the bypass circuit 22 and directs working fluid through line 24 to the expander 14. The admission of working fluid at operational condition (i.e., as steam) to the relatively cold expansion machine can cause thermal shock to the expansion machine. In addition, working fluid may be cooled to condensation temperatures in losing heat to the machine structure, causing corrosion, pitting, or other damage.

Figure 3:
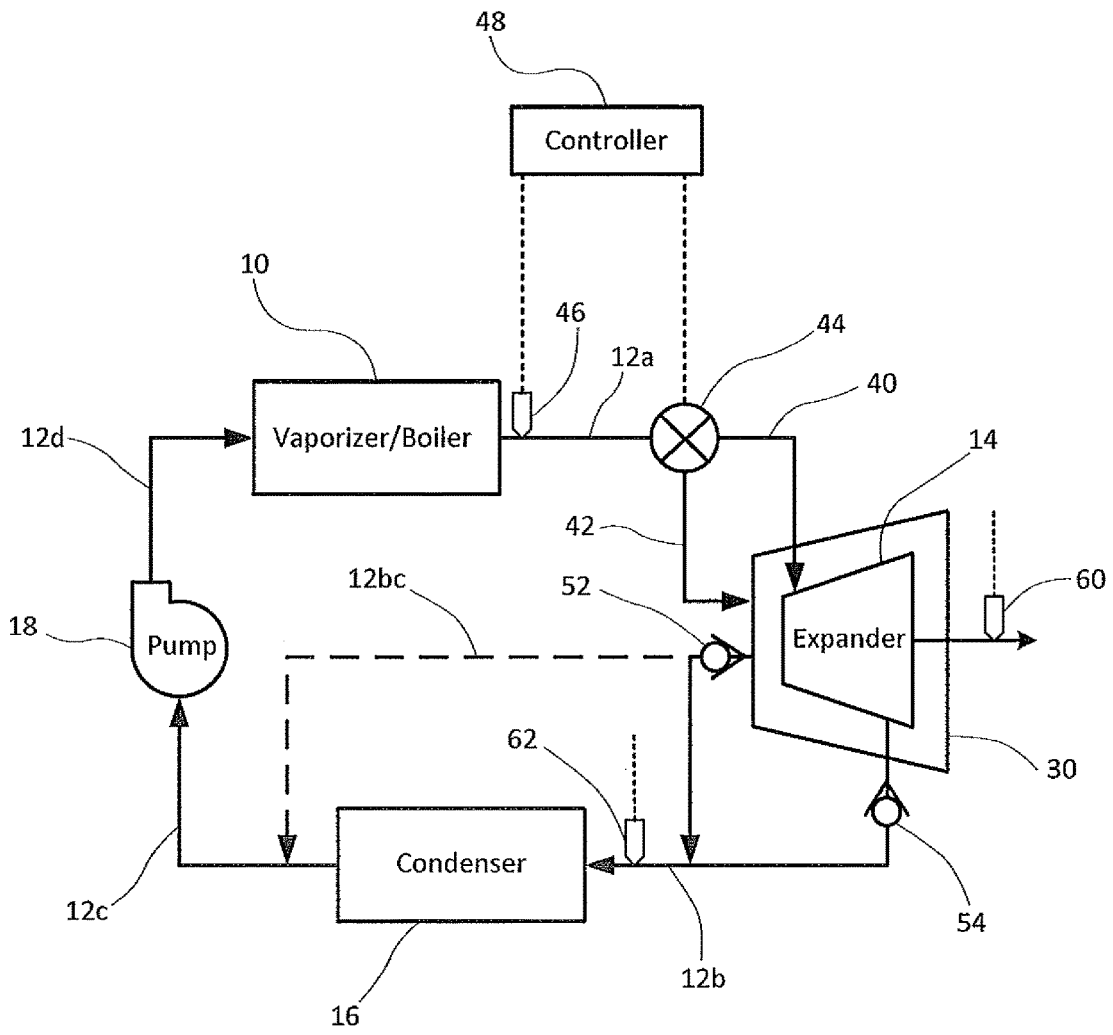
FIG. 3 is a schematic view of a bottoming cycle according to an embodiment of the invention in which an expansion machine has a heating jacket to receive working fluid for warming the expansion machine.

FIG. 3 illustrates an embodiment of the invention. The apparatus of FIG. 3 includes a heating jacket 30 structurally associated with the expander 14. Rather than the bypass valve and bypass circuit of FIG. 2, a first branch 40 of the working fluid circuit line 12*a* connects to the expander 14 and a second branch 42 connects to the heating jacket 30. A valve 44 controls whether working fluid flows through the first branch 40 or the second branch 42. The heating jacket 30 circulates working fluid as a warming fluid around the expander to heat it before it becomes operational or maintain a temperature between operational phases.

The heating jacket 30 may be formed as a water jacket known in the art for cooling engine components. The heating jacket may be one or more passageways formed to carry working fluid in heat transfer contact with the expansion machine structure.

Check valves 52, 54 at the outlets of the heating jacket 30 and the expander 14 prevent fluid from flowing back into the heating jacket and expander. The working fluid directed through and exiting the heating jacket 30 may optionally bypass the condenser 16, as shown by broken line 12*bc*.

The bypass valve 44 may be operated based on a sensed temperature of the working fluid exiting the boiler 10. A temperature sensor 46 at the outlet of the boiler 10, or on the working fluid circuit 12*a* on the outlet side of the boiler, may be connected to provide a temperature signal to a controller 48, which is connected to control the bypass valve 44.

The bypass valve 44 may also be regulated based on other operational conditions. For example, flow of the working fluid to the first branch 40 may be portioned to control a rotation speed of the expansion machine. A speed sensor 60 may be provided on the expander output shaft 15 and connected to deliver a speed signal to the controller 48. In addition or alternatively, the bypass valve 44 may be operated for working fluid temperature regulation, for example, by dividing working fluid into portions flowing through the heating jacket 30 and expansion machine 14. A temperature sensor 62 on the outlet side of the expander (or at the inlet of the condenser) can monitor temperature of the exiting, expanded working fluid and provide a signal the controller. As yet another alternative, working fluid flow may be controlled responsive to expansion machine output torque demand (such as a request to stop power generation during engine brake mode). The controller 48 according to this aspect of the invention is connected to receive a signal from a device that receives the output torque of the expander, such as the drive shaft of an internal combustion engine (not illustrated) or an electric generator/battery apparatus (also not illustrated).

Figure 4:
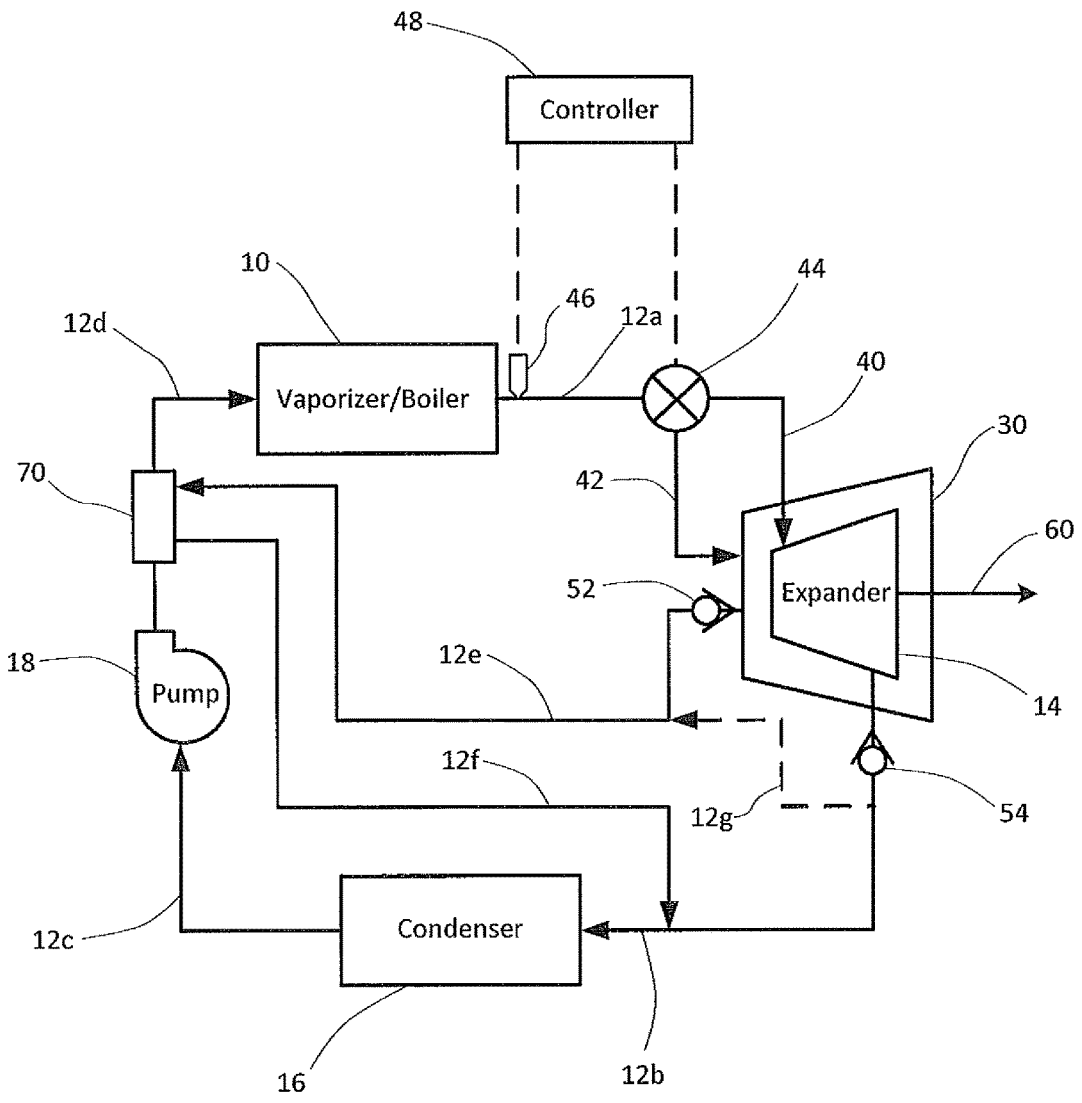
FIG. 4 is a schematic view of an alternative embodiment of the apparatus of FIG. 3.

An alternative embodiment of the apparatus, shown in FIG. 4, may include a recuperator 70 upstream of the boiler 10. Working fluid exiting the heating jacket 30 may be carried by line 12*e* to the recuperator 70 to transfer energy to the working fluid entering the boiler to improve efficiency. The working fluid exiting the recuperator 70 is carried by line 12*f* to the condenser 16. This reduces the load on the condenser 16 and decreases the amount of energy the boiler 10 must add to the fluid to generate steam. The working fluid circuit exiting the expander 14 may also be directed through the recuperator 70, as indicated by the broken line 12*g*, before being directed to the condenser 16.

Figure 5:
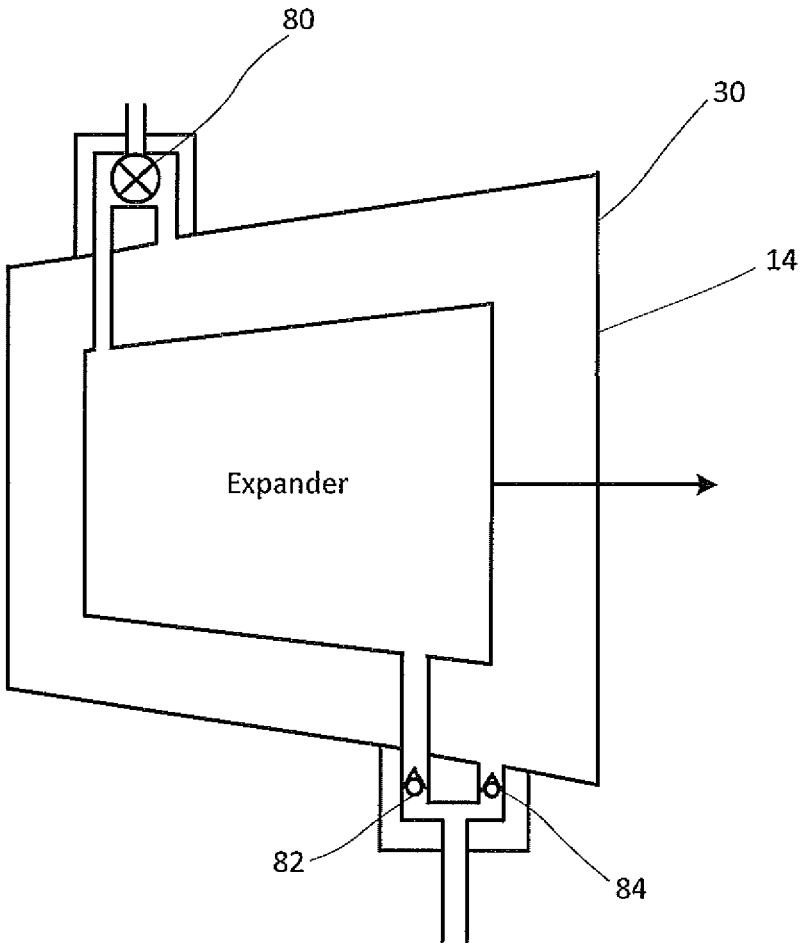
FIG. 5 is an alternative embodiment of an expander in accordance with the invention.

As shown in FIG. 5, a valve arrangement 80 for controlling the flow of working fluid into the heating jacket 30 or the expander 14, as well as the check valves 82, 84 for working fluid outlet, may be integrated with the heating jacket to simplify the arrangement. As illustrated, the valve 80 on the inlet side and the outlet 86 may be formed as manifolds on the heating jacket 30.

Figure 6:
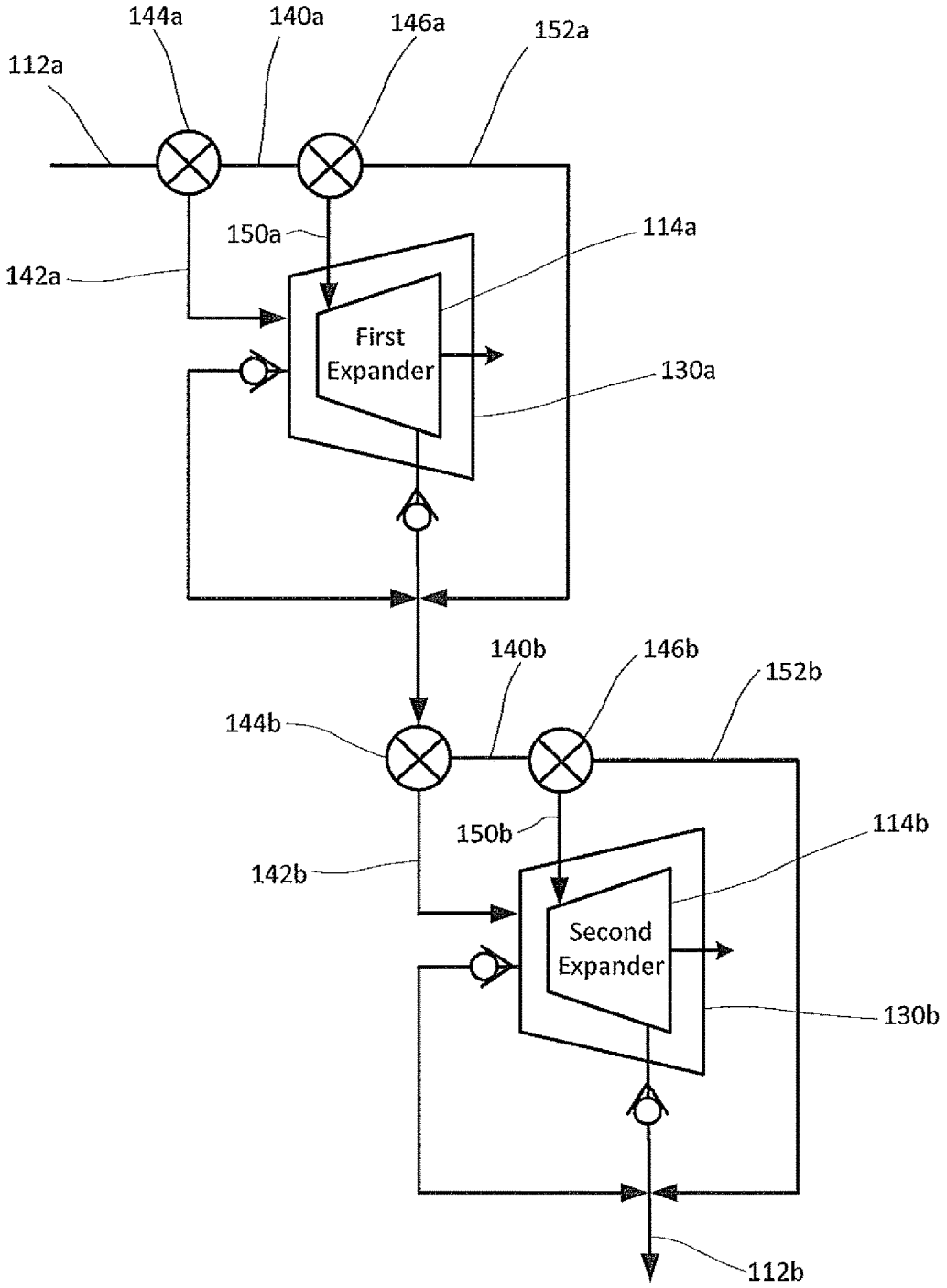
FIG. 6 illustrates an alternative arrangement of multiple expanders having working fluid heating jackets.

FIG. 6 illustrates an arrangement of two expanders 114*a*, 114*b* connected in series. Both the first expander 114*a* and the second expander 114*b* are shown with heating jackets 130*a*, 130*b*. Each expander stage 114*a*, 114*b* includes a bypass valve 144*a*, 144*b* to control whether the working fluid is directed through a first branch 140*a*, 140*b* to the expander for generating work or through a second branch 142*a*, 142*b* to the respective heating jacket 130*a*, 130*b* to heat the expander. In each arrangement, the first branch 140*a*, 140*b* further divides to a first line 150*a*, 150*b* to deliver working fluid to the expander 114*a*, 114*b*, and a second line 152*a*, 152*b* to bypass the expander. A second valve 146*a*, 146*b* controls whether the working fluid passes through the first line 150*a*, 150*b* or the second line 152*a*, 152*b*.

The arrangement of FIG. 6 can include a controller as shown in the embodiments of FIGS. 3 and 4, connected in a similar manner to control the valves.

The invention has been described in terms of preferred principles, embodiments, and components. Those skilled in the art will understand that substitutions may be made for the components shown without departing from the scope of the invention as defined by the appended claims.

The invention claimed is:

1. A waste heat recovery apparatus, comprising;

a working fluid circuit to circulate working fluid;

a boiler connected on the working fluid circuit and configured to recover waste heat from a source and transfer recovered waste heat to the working fluid;

a temperature sensor disposed to sense a temperature of the working fluid at an exit of the boiler and generate a temperature signal representative thereof;

an expander connected on the working fluid circuit to receive working fluid from the boiler; and, a heating jacket in heat transfer contact with the expander;

wherein, the working fluid circuit downstream of the boiler includes a first branch connecting to the expander and a second branch connecting to the heating jacket, and comprising a first valve to selectively control working fluid flow to the first branch and second branch, wherein the first valve controls working fluid flow proportionately to the first branch and second branch; and, a controller connected to receive the temperature signal from the temperature sensor and connected to control the first valve, the controller configured to control the first valve responsive to the temperature signal.

2. The waste heat recovery apparatus of claim 1, comprising:

a condenser connected on the working fluid circuit to receive working fluid from the expander and the heating jacket; and, a pump connected on the working fluid circuit to receive working fluid from the condenser, the pump adapted to compress the working fluid and direct the working fluid to the boiler.

3. The waste heat recovery apparatus of claim 2, comprising a recuperator connected to receive working fluid from the heating jacket and direct working fluid to the condenser.

4. The waste heat recovery apparatus of claim 2, comprising a recuperator connected to receive working fluid from the expander and direct working fluid to the condenser.

5. The waste heat recovery apparatus of claim 1, comprising a recuperator connected to receive working fluid from the heating jacket.

6. The waste heat recovery apparatus of claim 1, comprising a recuperator connected to receive working fluid from the expander.

7. The waste heat recovery apparatus of claim 1, wherein the first valve is mounted on the heating jacket and wherein the first branch and the second branch extend from the first valve.

8. The waste heat recovery apparatus of claim 1, wherein the first branch includes a first line connecting to an inlet of the expander and a second line bypassing the expander, and comprising a second valve to selectively control flow through one of the first line and second line.

9. A waste heat recovery apparatus, comprising:

a working fluid circuit to circulate working fluid;

a boiler connected on the working fluid circuit and configured to recover waste heat from a source and transfer recovered waste heat to the working fluid;

a first expander connected on the working fluid circuit to receive working fluid from the boiler; and, a heating jacket in heat transfer contact with the first expander;

wherein, the working fluid circuit downstream of the boiler includes a first branch connecting to the first expander and a second branch connecting to the heating jacket, and comprising a valve to selectively control working fluid flow to the first branch and second branch;

a second expander connected on the working fluid circuit downstream of the first expander; and, a second heating jacket associated with the second expander, wherein, the working fluid circuit downstream of the first expander includes a third branch connecting to the second expander and a fourth branch connecting to the second heating jacket, and comprising a second valve to selectively control working fluid flow to the third branch and fourth branch.

10. The waste heat recovery apparatus of claim 9, wherein the third branch includes a first line connecting to an inlet of the second expander and a second line bypassing the second expander, and comprising a line valve to selectively control flow through the first line and second line.

11. The waste heat recovery apparatus of claim 10, wherein the line valve controls working fluid flow proportionately to the first line and second line.

12. The waste heat recovery apparatus of claim 9, wherein the first branch includes a first line connecting to an inlet of the expander and a second line bypassing the expander, and comprising a third valve to selectively control flow through one of the first line and second line.

13. The waste heat recovery apparatus of claim 12, wherein the third valve controls working fluid flow proportionately to the first line and the second line.

14. The waste heat recovery apparatus of claim 9, wherein the second valve controls working fluid flow proportionately to the third branch and the fourth branch.

* * * * *